US006295904B1

(12) United States Patent
Webb

(10) Patent No.: US 6,295,904 B1
(45) Date of Patent: Oct. 2, 2001

(54) INSULATED TORQUE LEVER DRIVING TOOL

(76) Inventor: James Webb, 3112 Kashiwa St., Torrance, CA (US) 90505-4011

( * ) Notice: Subject to any disclaimer, the term of this patent is extended or adjusted under 35 U.S.C. 154(b) by 0 days.

(21) Appl. No.: 09/546,220

(22) Filed: Apr. 10, 2000

(51) Int. Cl.[7] ..... B25G 1/100
(52) U.S. Cl. ..... 81/492; 81/489; 81/177.6
(58) Field of Search ..... 81/489, 492, 177.1, 81/177.6, 58.1, 177.02

(56) References Cited

U.S. PATENT DOCUMENTS 456,300 * 7/1891 Dawson ..... 81/177.6
751,496 * 2/1904 Gode ..... 81/489
1,530,905 * 3/1925 Nance ..... 81/177.6
2,778,396 * 1/1957 Swain ..... 81/177.6
5,211,468 * 5/1993 Jeng ..... 362/120
5,431,075 * 7/1995 Cruz ..... 81/492
5,526,724 * 6/1996 Bruggeman ..... 81/492
5,823,078 * 10/1998 Liu ..... 81/492

* cited by examiner

*Primary Examiner*—Joseph J. Hail, III
*Assistant Examiner*—Joni B. Danganan
(74) *Attorney, Agent, or Firm*—Roger A. Marrs

(57) ABSTRACT

A fastener driving assembly or tool includes a metal handle having opposite ends with an elongated driver shaft projecting from one end and a swivel knob installed on the other end. An electrical insulator is installed between the handle and the driver shaft and an insulating filler secures the shaft, insulator and handle together. The handle includes a recess for storing a lever arm or breaking bar adapted to outwardly pivot with respect to the longitudinal axis of the handle and driver shaft. A pivot rotatably connects one end of the lever arm with the handle.

9 Claims, 1 Drawing Sheet

23
22
11
12
15
15'
16
13
17
21
18
20
24
25
26
28
27
14
33
30
31
35
32
36
4

INSULATED TORQUE LEVER DRIVING TOOL

BACKGROUND OF THE INVENTION

1. Field of the Invention

The present invention relates to the field of hand tools and more particularly to a novel driving tool for screws, nuts, bolts or other fasteners and which incorporates fold-out torque lever arms, a swivel bearing at the top for increasing speed rotation and further including an insulation barrier between the driver shaft and a metal handle to avoid electrical shock.

2. Brief Description of the Prior Art

In the past, it has been the conventional practice to employ a driver for installing or removing fasteners involving a twisting or rotational movement and such driving tools include a handle with a fixed driver shaft outwardly projecting from the end of the handle. In most instances, the user must grasp the handle and perform a twisting movement, followed by releasing the handle and gripping a second time to again twist the handle so that sequential or repeated gripping and twisting will cause the drive shaft to eventually install or remove a fastener. Also, conventional drivers subject the user to hand abrasion and to electrical shock should the driving shaft engage an electrical wire or circuit during use. This is a particular problem when metallic handles are employed. Additionally, fasteners which are intended to be removed are sometimes difficult to remove since corrosion or the like may somewhat freeze the fastener in its location. Under such circumstances a considerable amount of twisting is required and it would be helpful if the user had some means for providing increased torque for the twisting movement.

Therefore, a long standing need has existed to provide a novel driving tool which has the capability of providing extra torque during the twisting procedure and which further includes a swiveling feature to permit speed rotation of the driving tool without abrasion to the operator and which allows for ease of consistent alignment with respect to the end of the driving tool with the fastener intended to be driven. An electrical non-conductive insulator is desirable between the driver shaft and the metallic handle held by the user which will avoid or prevent electrical shock to the user.

SUMMARY OF THE INVENTION

Accordingly, the above problems and difficulties are avoided by the present invention which provides a novel driver assembly or tool for installing or removing a fastener which includes an elongated handle having opposite ends from which a driver shaft outwardly projects from a selected end. The free end of the driver shaft includes a fastener engaging end which preferably is shaped to fit the configuration of the fastener intended to be driven. The non-selected end of the handle includes a rotation means permitting the handle and driver shaft to be spun or rotated during the fastener turning procedure. In one form, a rotating knob is mounted on the non-selected end of the handle by means of a bearing. Non-conductivity between a metal handle and the driver shaft is achieved by incorporation of an insulating filler means critically disposed between the attachment of the driver shaft to the selected end of the handle, whereby the insulating filler means provides an electrical barrier for any electricity from an electrical circuit that may touch or engage with the shaft during the turning process. The inventive driver tool further includes a fold-out lever or breaker bar which resides within a storage slot recessed in the handle when not in use and which is adapted to outwardly deploy into an operative position. This latter position is normal with respect to the longitudinal axis of the drive shaft and handle so that the user is provided with additional torque during the twisting or rotating procedure to drive the fastener. Means are provided for locating the lever arm or breaker bar at a 90° deployment and preferably, the length of the lever or breaker bar is shorter than the length of the handle on which it is mounted. A pivot pin is employed for deployably mounting the lever arm or breaker bar onto the side of the handle adjacent to the recess.

Accordingly, it is among the primary object of the present invention to provide a fastener driver or driver tool which includes a torque lever arm or breaker bar that pulls or snaps in and out of the driver handle in order to provide extra torque drive for the user and which further may readily be stored within the handle or body of the tool when not in use.

Another object of the present invention is to provide a fastener driving tool which incorporates a swivel top cap that allows speed rotation of the driver tool without abrasion to the hand of the operator and which permits ease of consistent alignment of the drive shaft with the fastener intended to be driven.

A further object of the invention resides in providing an electrical insulative material between the drive shaft and handle of a driving tool which is aligned by a non-conductive centering insulator which is injected under high pressure into the handle within a receptacle between the handle and the drive shaft so as to expand and form a solid joint of high strength.

Still a further object is to provide an insulated torque lever driving tool having the above features which may be operated simultaneously to provide increased turning torque, non-conductivity of electricity and provides speed rotation without the necessity of having to add mechanical elements or removing any mechanical elements from the tool so that the inventive driving tool is integral and of a unitary construction.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figures 1, 2, 3, 4:
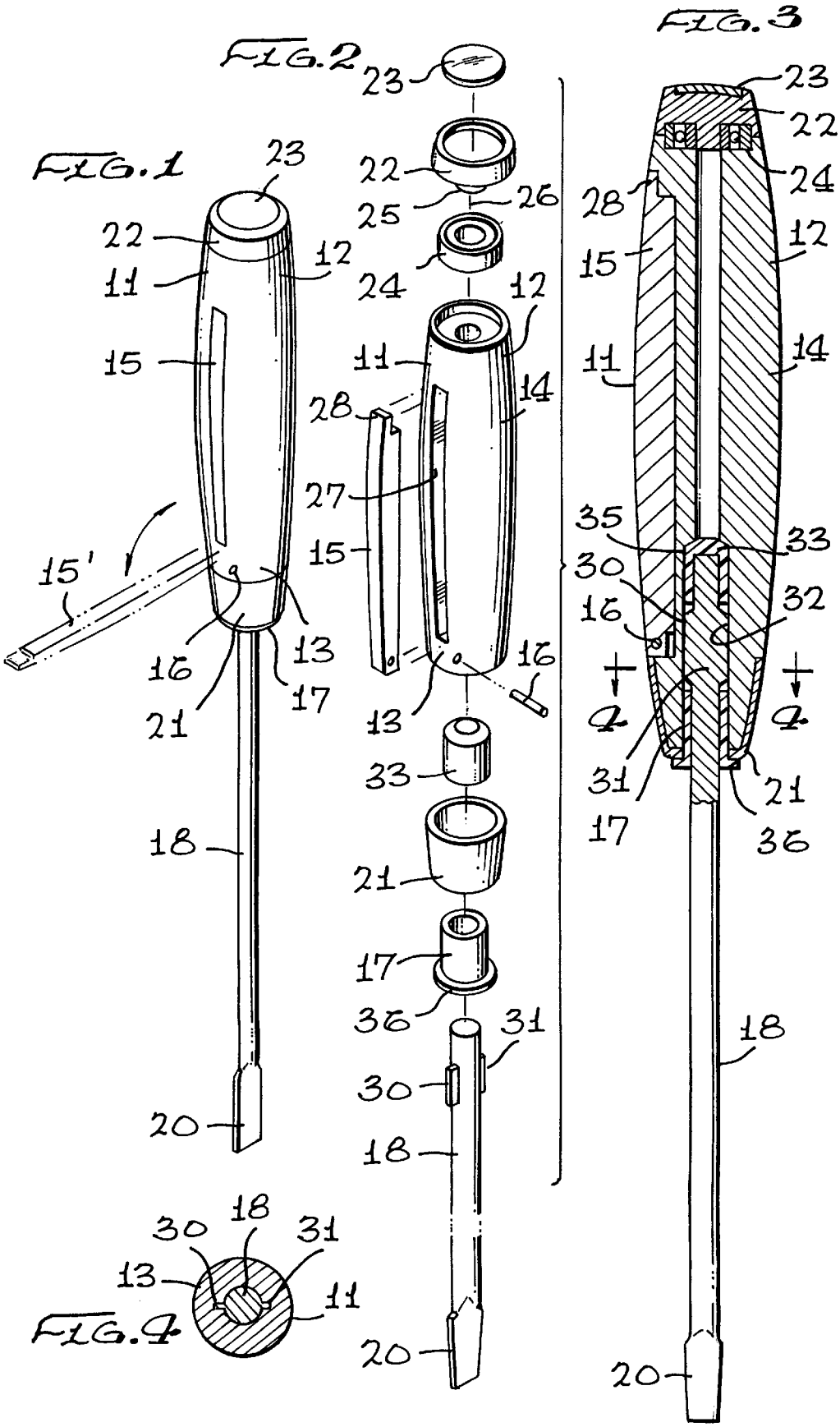
FIG. 1 is a front perspective view showing the novel insulated torque lever driving tool incorporating the present invention.
FIG. 2 is an exploded view of the driving tool shown in FIG. 1 illustrating the arrangement of components.
FIG. 3 is a longitudinal sectional view of the driving tool.
FIG. 4 is a transverse cross-sectional view of the driving tool as shown in FIG. 3 as taken in the direction of arrows 4—4 thereof.

Referring to FIG. 1, the move insulated torque lever driving tool is illustrated in the general direction of arrow 10 which includes an elongated metal handle 11 of substantially cylindrical shape which includes an external surface intended to be gripped by the hand of the user. The handle includes a top end 12 and a lower or bottom end 13 integrally joined together by means of a mid-section 14. The midsection includes an elongated recess opening through the external surface of the mid-section and the recess is occupied in an interference fit by a breaker bar or lever art 15. The lever arm is illustrated in broken lines in ites fully deployed position and is represented by numer 15 prime. One end of the lever arm 15 is pivotally secured to the lower portion of end 13 of the handle by means of a pivot 16. A lower shaft or shank insulator 17 electrically insulates the handle from an elongated metal shank or shaft 18 which has a free end shaped to the compatible with a variety of fasteners such as screws, nuts, bolts or the like. The fastener engaging tin is indicated by numeral 20 and is illustrated as being flat so as to mate with a slot in a screw. It is to be understood that the showing of a flat tip is for illustrative and example purposes only. The lower shank insulator 17 is covered by a carbon fiber conical cover 21 which is sucured to the extreme lower end of the handle 11.

The upper section or portion 12 of the handle 11 mounts a swivel arrangement which includes a rotating knob 22 positioned on top of a bearing 24 shown in FIGS. 2 and 3. The rotating knob 22 may be employed for carrying a button 23 which may display advertising data, graphic representations or other indicia.

Referring to FIG. 2, it can be seen that the upper section or portion 12 of the handle 11 supports a bearing 24 which in turn mounts the rotating knob 22. A downwardly depending projection 25 fits into the center bore of the inner race of the bearing 24 so that the button and rotating knob can readily by rotated about a central longitudinal axis indicated by numeral 26. Also, FIG. 2 illustrates that the mid-section 14 of the handle includes an elongated recess 27 into which the lever arm 15 can be stored when it is not in its operative position as shown in broken lines by numeral 15 prime in FIG. 1. The pivot pin 16 passes through the lower portion 13 of handle 11 and through the end of the lever arm 15 to provide for pivotal movement. The opposite end of the lever arm from its end connected with pivot 16 includes a terminating, reduced portion 28 which constitutes a tab for grasping by the fingers of the user so that the lever can be withdrawn from its storage position in recess 27 into its operative position shown in broken lines in FIG. 1.

The shank or shaft 18 includes a pair of projections 30 and 31 which connect with the lower end of handle 11 after the upper end of the shank or shaft has been inserted into a receiving receptacle such as indicated by numeral 32 in FIG. 3. The projections help to maintain the shaft 18 in securement with the handle. It is to be particularly noted in FIG. 3 that the metal shank or shaft 18 is electrically insulated from the handle 11 by means of the lower insulator 17 and an upper shank insulator 33. The upper shank insulator completely covers the extreme upper end of the shaft or shank 18 and the upper and lower shank insulators are separated by the projections 30 and 31. The shaft 18 is completely insulated from the handle not only by the upper and lower insulators but by the use of an epoxy filler indicated by numeral 35 which binds and secures the insulators and the portion of the shank between the two insulators as well as the projections to the handle itself. Therefore, a complete electrical conductive barrier is established between the handle and the shank 18. To further insulate, it can be seen that the lower shank insulator 17 includes an outwardly projecting flange 36 which bears against the underside of the carbon fiber cover 21.

In FIG. 3, an assembled insulated torque lever driving tool is provided and it can be seen that all of its components are in coaxial relationship along central longitudinal axis of the tool. The breaker bar or lever arm 15 is readily deployable from the side of the handle 11 from its storage position into its operative position.

In view of the foregoing, it can be seen that the novel driving tool of the present invention includes a metallic driving tool useful in an electrician's environment. The features of the inventive driving tool allow for the design of a fully, professional high-end screwdriver or the like with insulating qualities of a molded product. The driving tool will be enhanced with an all billet aluminum machine handle with a fold-out lever, a swivel bearing top for speed rotation and a special insulating feature between the metal handle and the driver shaft to eliminate shock, electrical or temperature transfer to the handle. The deployable torque lever arm or breaker bar folds/snaps out of a storage recess for easy and extra torque requirements and the lever arm is then easily pivoted back into a storage position within the mid-section of the handle. The top swivel cap is a feature that allows speed rotation without abrasion to the hand of the operator and further allows for ease of consistent alignment. The shaft 18 is insulated from the handle by employing aligned non-conductive centering upper and lower insulators and then injected with a high-pressure, expanding, non-conductive epoxy-type component to allow strength and non-conductivity transfer to the handle.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A hand-held fastener driving tool comprising:

a metal handle having a top end and a bottom end integrally joined by a mid-section;

a driver shaft outwardly projecting from said bottom end and terminating with a fastener engaging tip;

lever means carried in said metal handle for outward deployment from said metal handle to an operative position normal to said driver shaft;

insulated securement means disposed between said bottom end and said driver shaft for joining said driver shaft with said metal handle and constituting an electrical barrier between said driver shaft and said metal handle; and swivel means carried on said top end of said metal handle for providing speed rotation of said handle and said driver shaft as a unit.

2. The hand-held fastener driving tool defined in claim 1 wherein:

said lever means includes an extendable arm pivotally carried on said metal handle and having a storage position within a recess provided on said metal handle and outwardly projecting laterally from said metal handle in said operative position.

3. The hand-held fastener driving tool defined in claim 2 wherein:

said insulative securement means includes an upper insulator installed on said driver shaft and a lower insulator carried on said driver shaft in spaced-apart relationship with said upper insulator; and an insulating filler binding said upper insulator and said lower insulator to said bottom end of said metal handle and to said driving shaft.

4. The hand-held fastener driving tool defined in claim 3 wherein:

said swivel means includes a bearing mounted on said top end of said metal handle;

a knob rotatably carried on said bearing; and a button mounted on said metal handle engageable with said bearing to permit relative rotary movement between said knob and said button.

5. The hand-held fastener driving tool defined in claim 4 wherein:

said driver shaft includes a pair of outwardly extending securement projections disposed between said upper insulator and said lower insulator.

6. The hand-held fastener driving tool defined in claim 5 wherein:

said lower insulator includes a flange externally disposed and bearing against said metal handle bottom end.

7. The hand-held fastener driving tool defined in claim 6 including:

a carbon fiber cover of conical configuration mounted on said metal handle bottom end and partially disposed between said metal handle and said lower insulator flange.

8. The hand-held fastener driving tool comprising:

an elongated metal handle having a top-end section and a bottom end section separated by a midsection;

said bottom end section having an open passageway lying along a central longitudinal axis of said metal handle;

an elongated driver shaft having a first end fixedly secured in said passageway to said metal handle;

insulation material occupying said passageway about said first end and between said driver shaft and said metal handle to define a non-conductive layer to prevent electrical conduction;

a recess provided in said midsection of said handle and a torque arm pivotally attached to said metal handle at said bottom end section and said torque arm having a storage position within said recess and an operative position extending outward from said metal handle at a 90° angle respective to said central longitudinal axis;

a swivel means carried on said top end section of said metal handle; and said swivel means includes a bearing having an outer race secured to said top-end section of said metal handle and an inner race supporting a turning knob whereby said metal handle and said driver shaft are rotated in unison when said turning knob is stationary.

9. The hand-held fastener driving tool defined in claim 8 wherein:

said torque arm is maintained in said recess by an interference fit.

* * * * *